United States Patent [19]

Brown et al.

[11] 4,002,526

[45] Jan. 11, 1977

[54] OXYGEN-ALKALI DELIGNIFICATION OF LOW CONSISTENCY WOOD PULP

[75] Inventors: Kenton J. Brown, Suffern; Arthur W. Kempf, Warwick, both of N.Y.

[73] Assignee: International Paper Company, New York, N.Y.

[22] Filed: Oct. 10, 1975

[21] Appl. No.: 621,355

[52] U.S. Cl. ..... 162/57; 8/111; 162/65; 162/72; 162/90

[51] Int. Cl.[2] ..... D21C 9/10

[58] Field of Search ..... 162/57, 65, 63, 70, 162/81, 72, 82, 76, 86, 90, 89; 8/111

[56] References Cited

UNITED STATES PATENTS

| | | | |
|---|---|---|---|
| 2,071,304 | 2/1937 | Hirschkind | 162/72 X |
| 2,271,218 | 1/1942 | Baudisch | 162/72 X |
| 2,361,639 | 10/1944 | Loughborough | 162/72 X |
| 2,372,561 | 3/1945 | Elgin | 162/72 X |
| 2,394,989 | 2/1946 | Dreyfus | 162/76 |
| 2,457,856 | 1/1949 | Zechuisen | 162/72 X |
| 3,274,049 | 9/1966 | Gaschke et al. | 162/65 |
| 3,308,012 | 3/1967 | Tobar | 162/76 X |
| 3,368,935 | 2/1968 | Heald | 162/72 |
| 3,472,731 | 10/1969 | Liebergott et al. | 162/63 |
| 3,507,743 | 4/1970 | Cartsunis et al. | 162/72 |
| 3,572,987 | 3/1971 | Grunow | 162/72 X |
| 3,622,444 | 11/1971 | Andrews | 162/63 X |
| 3,740,310 | 6/1973 | Smith et al. | 162/65 |
| 3,740,311 | 6/1973 | Liebergott et al. | 162/65 |
| 3,832,276 | 8/1974 | Roymoulik et al. | 162/65 |

OTHER PUBLICATIONS

Aldrich, "Cellulose Degradation Inhibitors for the Chlorination Stage," TAPPI vol. 51, No. 3, pp. 71A–74A, 3–1968.

Pobar, "Sulfuric Acid in the Chlorination & Hydrochlorite Bleaching of Pulp," TAPPI vol. 47, No. 11, pp. 688–691.

Gudivaka et al., "Inhibitors in Pulp Bleaching," Indian Pulp & Paper, pp. 447–452, 1–1971.

*Primary Examiner*—S. Leon Bashore
*Assistant Examiner*—Arthur L. Corbin

[57] ABSTRACT

An process for increasing the yields of wood pulp and improving the viscosity of the pulp during oxygen-alkali delignification is provided whereby, in a wood pulp at a consistency of about 1–10%, there are present, in the pulp to be delignified, small amounts of ammonia or a compound which releases ammonia under the alkaline conditions of the process.

13 Claims, 1 Drawing Figure

SHRINKAGE VS. CONCENTRATION OF AMMONIA
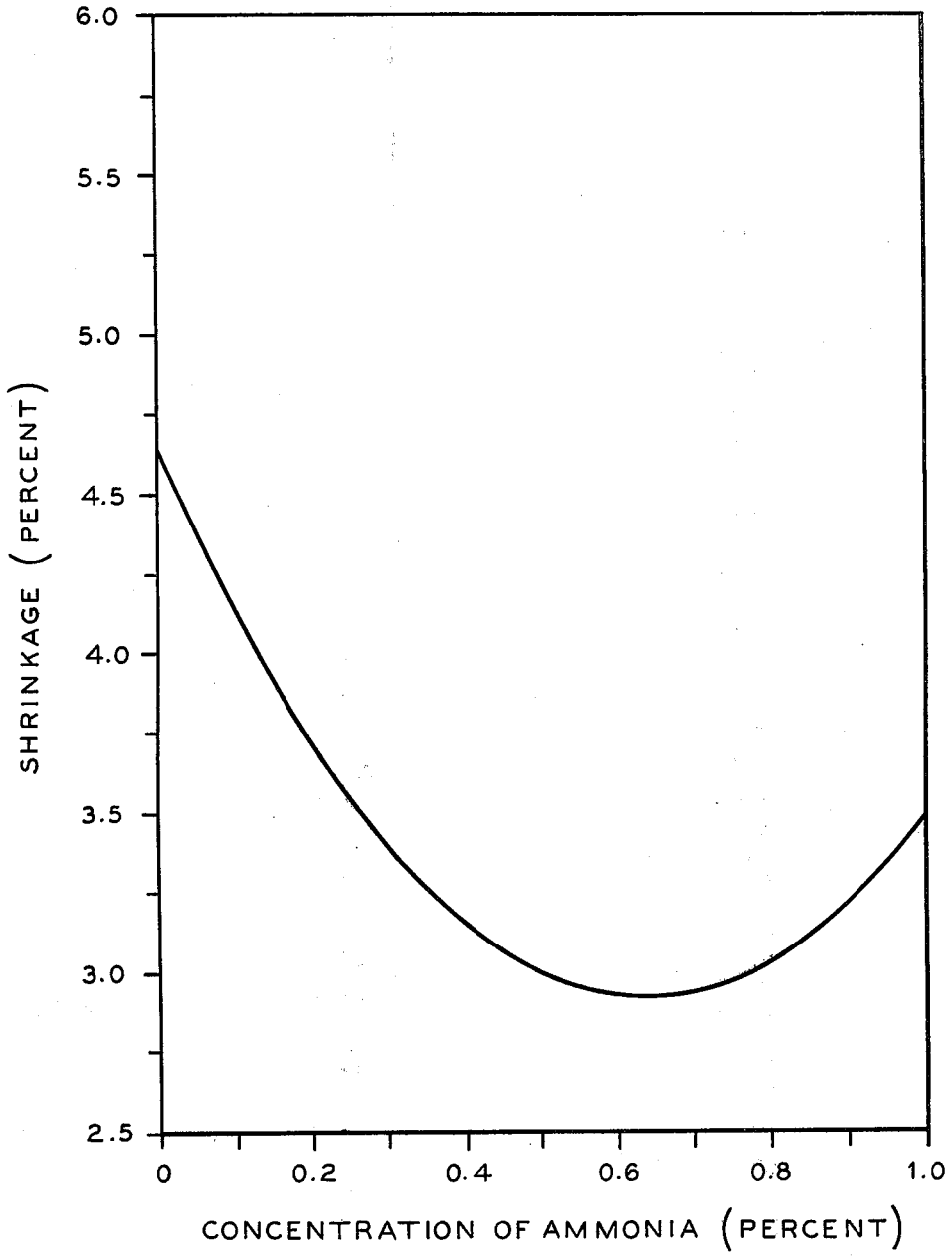

OXYGEN-ALKALI DELIGNIFICATION OF LOW CONSISTENCY WOOD PULP

BACKGROUND OF THE INVENTION

The present invention relates to an improved process for improving the yields of fibrous materials, such as wood pulp, and of increasing the viscosity of the delignified pulp, during an oxygen-alkali delignification or bleaching treatment. In the process, conducted at relatively low consistency, there are present small amounts of ammonia or a compound which will release ammonia under the alkaline conditions of the oxygen-alkali delignification.

Current interest in the paper industry has emphasized the desirability of delignifying wood pulp and other cellulosic fibrous materials using oxygen-alkali treatments. Such processes are desirable because they avoid the use of the traditional chlorination bleaching which uses a more expensive chemical and introduces complications due to the need to remove chlorine-containing by-products from the effluent streams. This requires expensive chemical recovery systems so as to abate stream and environmental pollution problems. A number of oxygen-alkali delignification processes have been presented, such as those of Richter U.S. Pat. No 1,860,432; Graangard et al. U.S. Pat. Nos. 2,926,116 and 3,024,158; Gaschke et al. U.S. Pat. No. 3,274,049; Meylan et al. U.S. Pat. No. 3,384,533; Watanabe U.S. Pat. No. 3,251,730; Rerolle et al. U.S. Pat. No. 3,423,282; Farley U.S. Pat. No. 3,661,699; and French patents 1,130,248 and 1,387,853. A more recent process which has been found to be particularly advantageous is that of Roymoulik et al. U.S. Pat. No. 3,832,276.

The Roymoulik et al. patent process is a highly satisfactory process. However, the paper industry continues to strive to improve pulp yields and to improve the quality of the pulp. It is known, for example, that oxygen-alkali delignification or bleaching methods tend to reduce the pulp viscosity. To counteract this problem, and to strive for optimum yields, various additives have been suggested in the oxygen-alkali treatments, such as magnesium salts, chelating agents and sequestering agents, have been employed in the systems in order to reduce the cellulose degradation which causes the unwanted reduction in pulp viscosities.

Yield loss during delignification or bleaching is not unique to oxygen-alkali delignification processes. It is encountered in many pulp treatments of cellulosic materials. With the increasing costs of the source of cellulosic materials, such as tree logs, the reduction of yield losses becomes of increasing importance to the paper industry. The search for means of reducing yield losses and viscosity losses has been going on for many years, even going back prior to the advent of oxygen-alkali delignification treatments.

One such suggested means of preventing viscosity reduction due to cellulose depolymerization or degradation is Heald U.S. Pat. No. 3,368,935. That patent is directed to a sulfite pulping process where urea is employed in the cooking liquor to control pH and prevent depolymerization of the cellulose. Sulfite cooking liquors are, however, an entirely different system from an oxygen-alkali bleaching system. The reaction mechanisms in the two processes are entirely different.

Baudisch U.S. Pat. NO. 2,271,218 describes a method of producing textile fibers by treating corn straw in a solution of alkali and urea. The process is a two-stage pulping process in which corn straw is treated with alkali and urea in the first stage and defiberized mechanically in the second stage. Such a treatment is quite different from an oxygen-alkali delignification treatment.

Liebergott et al. U.S. Pat. No. 3,740,311 describes a process for the delignification of wood pulp in which the pulp is treated at a relatively high consistency with ammonia and oxygen. In the process, ammonia is the sole source of alkalinity. Gaschke et al. U.S. Pat. No. 3,274,049 is similar to the Liebergott patent and differs in that it is directed to the treatment of bagasse, but it also employs ammonia as the sole source of alkalinity.

A publication by Lyman C. Aldrich, "Cellulose Degradation Inhibitors for the Chlorination Stage," TAPPI, Vol. 51, No. 3, pp. 71A–74A (March 1968) describes the use of urea and ammonium hydroxide (actually ammonium chloride, which is formed by the instantaneous reaction with ammonium hydroxide on the chlorine-containing acidic treatment liquor) during chlorine bleaching to inhibit cellulose degradation. While the addition of urea and ammonium hydroxide improves pulp viscosity to some extent, it also produces pulps having higher permanganate numbers, reflecting a higher lignin content than the controls. Thus, in the chlorination bleaching treatment of the Aldrich publication, the addition of urea and ammonium hydroxide at levels of additive above 0.25% actually reduced the amount of delignification. This is a serious disadvantage in a process whose sole purpose is to remove lignin from the pulp and so that if any subsequent chemical treatment is involved, such as the use of chlorine dioxide in a subsequent treatment of the pulp, that treatment can be minimized. In the acidic chlorination conditions employed by Aldrich, the nitrogenous compounds react with the chlorine in the bleaching solutions to form chloro derivatives of the nitrogen compound, thus wasting bleaching chemical. Thus, the addition of urea of ammonia serves no useful purpose insofar as delignification is involved.

A paper by Tobar, "Sulfamic Acid in the Chlorination and Hypochlorite Bleaching of Pulp," TAPPI, Vol. 47, No. 11, pp. 688–691, and Tobar U.S. Pat. No. 3,308,012, describe the use of urea and ammonium chloride as cellulose stabilizers during alkaline hypochlorite bleaching. On page 691 of the publication, Tobar states that in a hypochlorite bleaching system, the addition of urea or ammonium chloride produced both a loss in brightness and a loss in pulp viscosity, thereby showing that these agents in such a system actually produce undesirable results.

Gudivaka et al., "Inhibitors in Pulp Bleaching", *Indian Pulp and Paper*, pp. 447–452, (January 1971) describe the use of urea, ammonia and sulfamic acid in the bleaching of pulp by chlorine or hypochlorite. Such a system is, of course, quite different chemically from oxygen-alkali bleaching system. The results obtained by the authors were inconclusive.

Viscosity represents a measurement of the average degree of polymerization of the cellulose in the pulp sample, i.e., the average chain length of the cellulose. Thus, decreases in viscosity values represent the extent of depolymerization or degradation caused by the bleaching process. Excessive degradation is to be avoided since it provides undesirable physical properties in any paper made from the pulp.

Kappa No. is determined by the potassium permanganate consumed by a sample of pulp and represents a measurement of its retained lignin content. The higher the Kappa No., the less bleached and delignified is the pulp. By comparing Kappa Nos. of samples before and after bleaching treatment, one can obtain an evaluation of the extent of delignification which has taken place.

It is, therefore, an object of the present invention to provide an improved process for the delignification or bleaching of pulp by the oxygen-alkali process.

It is another object of the present invention to provide a method of delignifying wood pulp which will reduce yield losses and provide a pulp of inmproved viscosity.

Further objects will be apparent to those skilled in the art from the present description, taken in conjunction with the appended drawing, which is a graph comparing the shrinkage or yield loss in the oxygen-alkali treatment of wood pulp with various concentrations of ammonia in the pulp.

GENERAL DESCRIPTION OF THE INVENTION

We have now discovered that unexpectedly improved pulp yields and higher pulp viscosities can be obtained in the oxygen-alkali delignification of pulp by introducing into the alkaline pulp at least about 0.1% by weight (based on oven-dried pulp) of ammonia or a compound which will release ammonia under the alkaline conditions of the process. In the alkaline conditions contemplated, the alkali solution, containing pulp, shall have a pH of between about 9 and 13. In the case of ammonia, amounts of up to about 3% by weight of oven-dried pulp have been found to provide excellent results and amounts above that provide no advantage and result in loss in economy. Preferred amounts of ammonia are between about 0.4% and 1% by weight with the optimum amount being about 0.6%. In the case of urea, and compounds releasing ammonia, amounts up to about 6% by weight provide satisfactory results and amounts in excess of this provide no economical advantage. When urea is employed as the compound resulting in ammonia, the preferred amount is from about 1% to 4% by weight of oven-dried pulp.

In the process, temperatures of between about 200° and 260° F. are desirable with the preferred temperature range being between about 210° and 220° F. The pressure of elemental oxygen in the system is desirably between about 30 and 300 psig. with the preferred partial pressure range being between about 120 and 130 psig. The amount of oxygen employed is desirably between about 1 and 10% based on oven-dried pulp. Air can be used as the source of oxygen, but this requires longer reaction times and the use of higher pressures.

The amount of alkali, such as sodium and potassium hydroxides, or carbonates, or mixtures thereof, employed is sufficient to provide a pH range of between about 9 and 13, preferred between about 11.5 and 12.5. The amounts of sodium or potassium hydroxides generally employed are between about 0.5 and 8 grams per liter, preferably about 2 to 4 grams per liter.

As presently contemplated, the process can be conducted in a time interval of from about 1 to 120 minutes, but usually 20 to 40 minutes is the most satisfactory time period.

The consistency of the pulp is lower than that employed in most prior art bleaching or delignification processes and the desirable range is between about 1% and 10% based on oven-dried pulp, with the preferable range being between about 3% and 5%.

In addition to ammonia, per se, ammonium salts such as the chloride, carbonate sulfite, nitrate or sulfate may be employed. Also, ammonia-releasing compounds may be employed, such as urea, sodium cyanate, hydrazine and substituted hydrazines such as alkyl substituted hydrazines, cyanuric acid, primary amides such as methyl and propyl amide, hydroxylamine, sodium or magnesium nitrides, sulfamic acid, etc.

The oxygen-alkali delignification treatment may desirably be conducted in accordance with the process and apparatus disclosed in Roymoulik et al. U.S. Pat. No. 3,832,276. However, it is not necessary to employ these conditions. The alkaline pulp, containing the source of ammonia, is desirably mixed with oxygen in a high-shear mixing device so as to bring the oxygen into intimate contact with the alkaline pulp. High-shear, high-speed mixing devices, such as the Lightnin' type mixer, are highly suitable for this purpose. Desirably, the alkaline aqueous pulp is briefly subjected to a high-pressure oxygen pre-treatment and thereafter the pressure is gradually reduced during the delignification process.

The wood chips or pulp may first be impregnated with a source of ammonia before being exposed to the alkaline solution and oxygen.

As shown in the accompanying drawing, shrinkage or reduction in yield varies with the concentration of ammonia in the process. As shown, the yield loss is minimized at a concentration of approximately 0.6% ammonia. The data for the graph were obtained by employing the procedure of Example 1 hereinbelow.

DETAILED DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLE 1

Kraft hardwood pulp was subjected to oxygen-alkali bleaching, using various concentrations of urea. In the runs, the pulp consistency was approximately 2% by weight of oven-dried pulp. The alkaline delignification solution contained 4 grams per liter of sodium hydroxide. The delignification was carried out at a temperature of 205° F. in a pressure reactor having intimately mixed with the alkaline pulp, oxygen at an initial pressure of 100 psig. That pressure was maintained for approximately 10 minutes followed by venting to 36 psig. pressure, followed by gradual reduction to zero psig. over a period of 42 minutes. The experiments were repeated at each concentration of urea for between 4 and 7 repetitions. The results are set forth in Table 1 below.

Table 1

| Experiment | Average Values: Kappa No. | Viscosity cp, at 0.5% | Yield % on OD Pulp | No. of Runs |
|---|---|---|---|---|
| Starting Pulp | 19.1 | 33.0 | — | — |
| Control | 11.0 | 23.0 | 95.3 | 6 |
| 0.5% Urea | 11.2 | 24.9 | 96.7 | 5 |

Table 1-continued

| Experiment | Average Values Kappa No. | Viscosity cp, at 0.5% | Yield % on OD Pulp | No. of Runs |
|---|---|---|---|---|
| 1.0% Urea | 10.8 | 25.9 | 96.2 | 4 |
| 2.0% Urea | 11.3 | 26.2 | 96.8 | 7 |
| 4.0% Urea | 11.6 | 26.5 | 96.6 | 4 |

EXAMPLE 2

The experiment of Example 1 was repeated employing various concentrations of ammonia, based on weight of oven-dried pulp, in place of the urea. Six runs were conducted for each concentration of ammonia. The results are shown below in Table 2.

Table 2

| Experiment | Average Values Kappa No. | Viscosity cp, at 0.5% | Yield % on OD Pulp | Brightness %, Elrepho |
|---|---|---|---|---|
| Starting Pulp | 19.1 | 33.0 | — | 26.3 |
| Control | 11.0 | 23.0 | 95.3 | 45.2 |
| 0.3% Ammonia | 10.5 | 26.3 | 96.7 | 46.8 |
| 0.6% Ammonia | 11.0 | 25.7 | 97.0 | 46.4 |
| 1.0% Ammonia | 10.5 | 26.3 | 96.7 | 46.1 |

EXAMPLE 3

A pilot plant run was conducted employing 0.6% ammonia in an oxygen-alkali system treating hardwood dissolving pulp of a consistency of 3% based on weight of oven-dried pulp. The pilot plant run was conducted in two parts. In one part referred to as "Conventional", the pulp, having a consistency of 3% based on oven-dried pulp, containing 1.8 grams per liter of sodium hydroxide, was mixed intimately with elemental oxygen to provide an initial pressure of 100 psig. and the pulp was maintained at a temperature of 205° F. for 10 minutes. Thereafter, the system was vented to 36 psig. pressure, the pressure was then gradually reduced to zero psig. over a period of 42 minutes. In the second portion of the pilot plant run conducted under what is referred to as "Split Flow" whereby the initial pulp consistency was 4.7% based on oven-dried pulp, containing 1.2 grams per liter of sodium hydroxide and the pulp treated at 230° F. at an initial oxygen pressure of 100 psig. After 16 minutes the temperature was reduced to 205° F., the consistency reduced to 3% by the addition of water, and the pressure reduced to 36 psig. and over 42 minutes the pressure was gradually reduced to zero psig. These pilot plant runs were conducted continuously for periods of 8 to 12 hours at the rate of 1 to 1.5 tons per day production of delignified pulp. The results are shown below in Table 3.

Table 3

| Flow Treatment | Pilot Plant Trials Using Ammonia-Kraft Dissolving Pulp — Average: Permanganate No. Start | Permanganate No. Final | Viscosity Start | Viscosity Final |
|---|---|---|---|---|
| Split Flow | | | | |
| Control | 5.4 | 2.9 | 32.8 | 12.7 |
| 0.6% Ammonia | 5.5 | 3.3 | 33.8 | 21.7 |
| Conventional | | | | |
| Control | 6.6 | 4.1 | 33.4 | 13.1 |
| 0.6% Ammonia | 6.5 | 4.7 | 40.4 | 26.4 |

As will be apparent to those skilled in the art from the present description, in the foregong examples the ammonia and the urea may be replaced by appropriate amounts of other compounds releasing ammonia, such as ammonium chloride, carbonate, sulfite, nitrate or sulfate, sodium cyanate, hydrazine, cyanuric acid, methylamide, hydroxylamine, sulfamic acid, and sodium or magnesium nitrides, etc.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An improved process for increasing the yields of wood pulp and improving the viscosity of the pulp during oxygen-alkali delignification, which consists of treating with oxygen and alkali an aqueous wood pulp slurry having a consistency of between about 1 and 10% based on oven-dried pulp and a pH within the range of between about 9 and 13 and containing a member selected from the class consisting of ammonia in an amount of between about 0.1 and 3% by weight of oven-dried pulp and a compound releasing ammonia in an amount of between about 0.1 and 6% by weight of oven-dried pulp, at a temperature between about 200° and 260° F. and at an oxygen pressure of between about 30 and 300 psig.

2. An improved process according to claim 1 wherein the amount of ammonia is between about 0.4 and 1% by weight of oven-dried pulp.

3. An improved process according to claim 1 wherein the amount of compound releasing ammonia is between about 1 and 4% by weight of oven-dried pulp.

4. An improved process according to claim 1 wherein the temperature is between about 210° and 220° F.

5. An improved process according to claim 1 wherein the oxygen pressure is between about 120 and 130 psig.

6. An improved process according to claim 1 wherein the pulp consistency is between about 3 and 5% by weight of oven-dried pulp.

7. An improved process according to claim 1 wherein the pH of said aqueous wood pulp slurry is between about 11.5 and 12.5.

8. An improved process according to claim 1 wherein the oxygen-alkali delignification is conducted over a time interval of from about 1 to 120 minutes.

9. An improved process according to claim 1 wherein the oxygen-alkali delignification is conducted over a time interval of from about 20 to 40 minutes.

10. An improved process according to claim 1 wherein the pressure during the oxygen-alkali delignification is gradually reduced.

11. An improved process according to claim 1 wherein the oxygen is intimately dispersed and subdivided into the pulp by means of a high-shear agitator.

12. An improved process according to claim 1 wherein the ammonia is present in an amount of about 0.6%.

13. An improved process according to claim 1 wherein said alkali is a member selected from the class consisting of sodium and potassium hydroxides and carbonates.

* * * * *

UNITED STATES PATENT AND TRADEMARK OFFICE

CERTIFICATE OF CORRECTION

PATENT NO. : 4,002,526

DATED : January 11, 1977

INVENTOR(S) : Kenton J. Brown et al.

It is certified that error appears in the above-identified patent and that said Letters Patent are hereby corrected as shown below:

Column 1, line 27, "2,926,116" should be -- 2,926,114 --.

Column 2, line 41, change "of" second occurrence to -- or --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*